US010336573B2

(12) United States Patent
Hovi et al.

(10) Patent No.: US 10,336,573 B2
(45) Date of Patent: Jul. 2, 2019

(54) PRE-ALLOCATION OF AN ELEVATOR CALL

(71) Applicant: KONE Corporation, Helsinki (FI)

(72) Inventors: Antti Hovi, Hyvinkää (FI); Claus Ingman, Riihimäki (FI); Jari Kallio, Hyvinkää (FI); Jukka-Pekka Sarjanen, Vantaa (FI); Niko Elomaa, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 381 days.

(21) Appl. No.: 14/747,964

(22) Filed: Jun. 23, 2015

(65) Prior Publication Data

US 2015/0291388 A1 Oct. 15, 2015

Related U.S. Application Data

(63) Continuation of application No. PCT/FI2013/050101, filed on Jan. 30, 2013.

(51) Int. Cl.

| | |
|---|---|
| ***B66B 1/34*** | (2006.01) |
| ***B66B 1/24*** | (2006.01) |
| ***B66B 1/46*** | (2006.01) |

(52) U.S. Cl.

CPC ..... *B66B 1/2408* (2013.01); *B66B 1/3492* (2013.01); *B66B 1/468* (2013.01); *B66B 2201/4615* (2013.01)

(58) Field of Classification Search

CPC ..... B66B 1/2408; B66B 1/3492; B66B 1/468; B66B 2201/4615

USPC ..... 187/247, 380–388, 391, 392, 393

See application file for complete search history.

(56) References Cited

U.S. PATENT DOCUMENTS

| | | | | |
|---|---|---|---|---|
| 5,949,037 | A * | 9/1999 | Oya | B66B 1/462 187/381 |
| 6,109,396 | A * | 8/2000 | Sirag | B66B 1/468 187/381 |
| 6,202,799 | B1 * | 3/2001 | Drop | B66B 1/468 187/384 |
| 6,209,685 | B1 * | 4/2001 | Zaharia | B66B 1/468 187/381 |
| 6,868,945 | B2 * | 3/2005 | Schuster | B66B 1/468 187/380 |
| 7,500,544 | B2 * | 3/2009 | Hakala | B66B 1/463 187/382 |
| 7,552,800 | B2 * | 6/2009 | Puskala | B66B 1/468 187/384 |

(Continued)

FOREIGN PATENT DOCUMENTS

WO WO 2008/040836 A1 4/2008

*Primary Examiner* — Anthony J Salata

(74) *Attorney, Agent, or Firm* — Birch, Stewart, Kolasch & Birch, LLP

(57) ABSTRACT

A method for allowing pre-allocation of an elevator call in an elevator system with destination control is provided. A first signal is received at an elevator group controller of an elevator system with destination control. The first signal indicates that a passenger including a passenger is detected to be approaching the elevator system at one of multiple floors associated with the elevator system. In response, allocation of an elevator call for the detected passenger is initiated, wherein the one of the multiple floors is assigned as the departure floor for the elevator call.

12 Claims, 3 Drawing Sheets

(56) References Cited

U.S. PATENT DOCUMENTS

| | | | | |
|---|---|---|---|---|
| 7,717,238 | B2 * | 5/2010 | Hamaji | B66B 1/468 187/392 |
| 8,061,485 | B2 * | 11/2011 | Finschi | B66B 1/468 187/384 |
| 8,348,021 | B2 * | 1/2013 | Finschi | B66B 1/468 187/382 |
| 8,439,169 | B2 * | 5/2013 | Iio | B66B 1/2458 187/387 |
| 8,490,754 | B2 * | 7/2013 | Amano | B66B 1/2458 187/384 |
| 8,544,612 | B2 * | 10/2013 | Korhonen | B66B 1/468 187/387 |
| 8,573,366 | B2 * | 11/2013 | Elomaa | B66B 1/2458 187/387 |
| 8,813,917 | B2 * | 8/2014 | Salmikuukka | B66B 1/468 187/247 |
| 8,939,263 | B2 * | 1/2015 | Tokura | B66B 1/2458 187/382 |
| 9,033,112 | B2 * | 5/2015 | Koba | B66B 1/2458 187/247 |
| 9,174,824 | B2 * | 11/2015 | Tokura | B66B 1/468 |
| 9,272,877 | B2 * | 3/2016 | Nakashima | B66B 1/468 |
| 9,284,158 | B2 * | 3/2016 | Sarjanen | B66B 1/468 |
| 9,323,232 | B2 * | 4/2016 | Blom | G05B 13/00 |
| 9,359,169 | B2 * | 6/2016 | Koba | B66B 1/2458 |
| 9,469,500 | B2 * | 10/2016 | Friedli | B66B 1/2408 |
| 9,580,272 | B2 * | 2/2017 | Kappeler | B66B 1/468 |
| 9,734,643 | B2 * | 8/2017 | Hanson | G07C 9/00039 |
| 2008/0011557 | A1 | 1/2008 | Hakala et al. | |
| 2008/0217112 | A1 | 9/2008 | Puskala et al. | |
| 2012/0037461 | A1 | 2/2012 | Finschi | |

* cited by examiner

PRE-ALLOCATION OF AN ELEVATOR CALL

CROSS REFERENCE TO RELATED APPLICATIONS

This application is a Continuation of PCT International Application No. PCT/FI2013/050101, filed on Jan. 30, 2013, which is hereby expressly incorporated by reference into the present application.

BACKGROUND OF THE INVENTION

Field of the Invention

The invention relates to pre-allocation of an elevator call. In particular, the invention relates to pre-allocation of an elevator call in an elevator system with destination control.

Description of the Related Art

From the point of view of controlling elevator cars, there are two major control arrangements in use today: elevator systems with traditional control and elevator systems with destination control.

In an elevator system with traditional control, controls both external and internal to an elevator car are provided. A passenger first operates the external controls, such as up and down buttons provided at each floor, to select the desired direction. In response to an up or down button pressed at a certain floor, the elevator arrives to pick up the passenger. Once inside the elevator car, the passenger operates call buttons inside the elevator car to choose his/her destination floor.

In an elevator system with destination control, destination control panels (also known as destination operating panels) are provided outside elevator cars (typically at each floor) where a passenger registers his/her destination floor call before entering the car. The system lets each passenger know which car to wait for, instead of everyone boarding the next car. Accordingly, travel time is reduced as the elevator car makes fewer stops for individual passengers, and the computer distributes adjacent stops to different cars in the bank. Typically, inside the elevator car there are no call buttons to push, but only indicators that indicate stopping floors. Elevator systems with destination control are typically used in sky-scraper buildings and other large buildings.

While an elevator system with destination control has several advantages over an elevator system with traditional control, the response time of the control system could still be further improved if elevator calls could be pre-allocated, that is, if the allocation of an elevator call could be started even before the passenger has entered his/her destination floor to the destination control panel.

Therefore, an passenger of the present invention is to alleviate the problems described above and to introduce a solution that allows pre-allocation of an elevator call in an elevator system with destination control.

SUMMARY OF THE INVENTION

A first aspect of the present invention is a method of pre-allocating an elevator call in which method a first signal is received at an elevator group controller of an elevator system with destination control. The first signal indicates that a passenger is detected to be approaching the elevator system at one of multiple floors associated with the elevator system. In response, allocation of an elevator call for the detected passenger is initiated, wherein the one of the multiple floors is assigned as the departure floor for the elevator call.

A second aspect of the present invention is an apparatus for pre-allocating an elevator call. The apparatus comprises at least one processor, and at least one memory including computer program code. The at least one memory and the computer program code are configured to, with the at least one processor, cause the apparatus at least to perform:

receiving, at an elevator group controller of an elevator system with destination control, a first signal indicating that a passenger is detected to be approaching the elevator system at one of multiple floors associated with the elevator system; and in response, initiating allocation of an elevator call for the detected passenger, with the one of the multiple floors assigned as the departure floor for the elevator call.

A third aspect of the present invention is apparatus for pre-allocating an elevator call. The apparatus comprises:

means for receiving, at an elevator group controller of an elevator system with destination control, a first signal indicating that a passenger is detected to be approaching the elevator system at one of multiple floors associated with the elevator system; and means for initiating allocation of an elevator call for the detected passenger in response, with the one of the multiple floors assigned as the departure floor for the elevator call.

A fourth aspect of the present invention is a computer program which comprises code adapted to cause the following when executed on a data-processing system:

receiving, at an elevator group controller of an elevator system with destination control, a first signal indicating that a passenger is detected to be approaching the elevator system at one of multiple floors associated with the elevator system; and in response, initiating allocation of an elevator call for the detected passenger, with the one of the multiple floors assigned as the departure floor for the elevator call.

A fifth aspect of the present invention is an elevator system with destination control which comprises the apparatus of the second or third aspect.

In an embodiment of the invention, a second signal is received at the elevator group controller.

The second signal indicates the destination floor selected by the passenger.

In an embodiment of the invention, in response to the received second signal, the allocation of the elevator call is completed for the detected passenger.

In an embodiment of the invention, the initiation of the allocation of the elevator call comprises assigning an elevator car for the elevator call.

In an embodiment of the invention, the initiation of the allocation of the elevator call further comprises launching the assigned elevator car towards the assigned departure floor.

In an embodiment of the invention, the first signal is received in response to a predetermined event that includes at least one of:

the passenger logs in to an access control system;

a distance sensor of the elevator system at the one of the multiple floors detects the passenger within a predetermined distance from a destination control panel of the elevator system at the one of the multiple floors;

the passenger operates the destination control panel of the elevator system; and a sensor of the elevator system at the one of the multiple floors detects the passenger being in the process of giving an elevator call.

In an embodiment of the invention, the predetermined event includes the passenger logging in to the access control system, wherein: the passenger is identified based on the logging in; and the elevator call is personalized for the passenger based on the identification.

In an embodiment of the invention, the computer program of the fourth aspect is stored on a computer readable medium.

It is to be understood that the aspects and embodiments of the invention described above may be used in any combination with each other. Several of the aspects and embodiments may be combined together to form a further embodiment of the invention. A method, an apparatus, a computer program or a system which is an aspect of the invention may comprise at least one of the embodiments of the invention described above.

The invention allows pre-allocation of an elevator call in an elevator system with destination control. This means that at least a portion of the computations in elevator call allocation can be performed in parallel with the passenger selecting his/her destination floor, rather than afterwards. This in turn allows an elevator car being assigned to the passenger faster than in prior art, as the elevator system can respond even before the passenger has completed his/her destination floor selection e.g. by launching an elevator car towards the departure floor of the passenger before the passenger has completed his/her destination floor selection.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE PREFERRED EMBODIMENTS

Reference will now be made in detail to the embodiments of the invention, examples of which are illustrated in the accompanying drawings.

Figure 1:
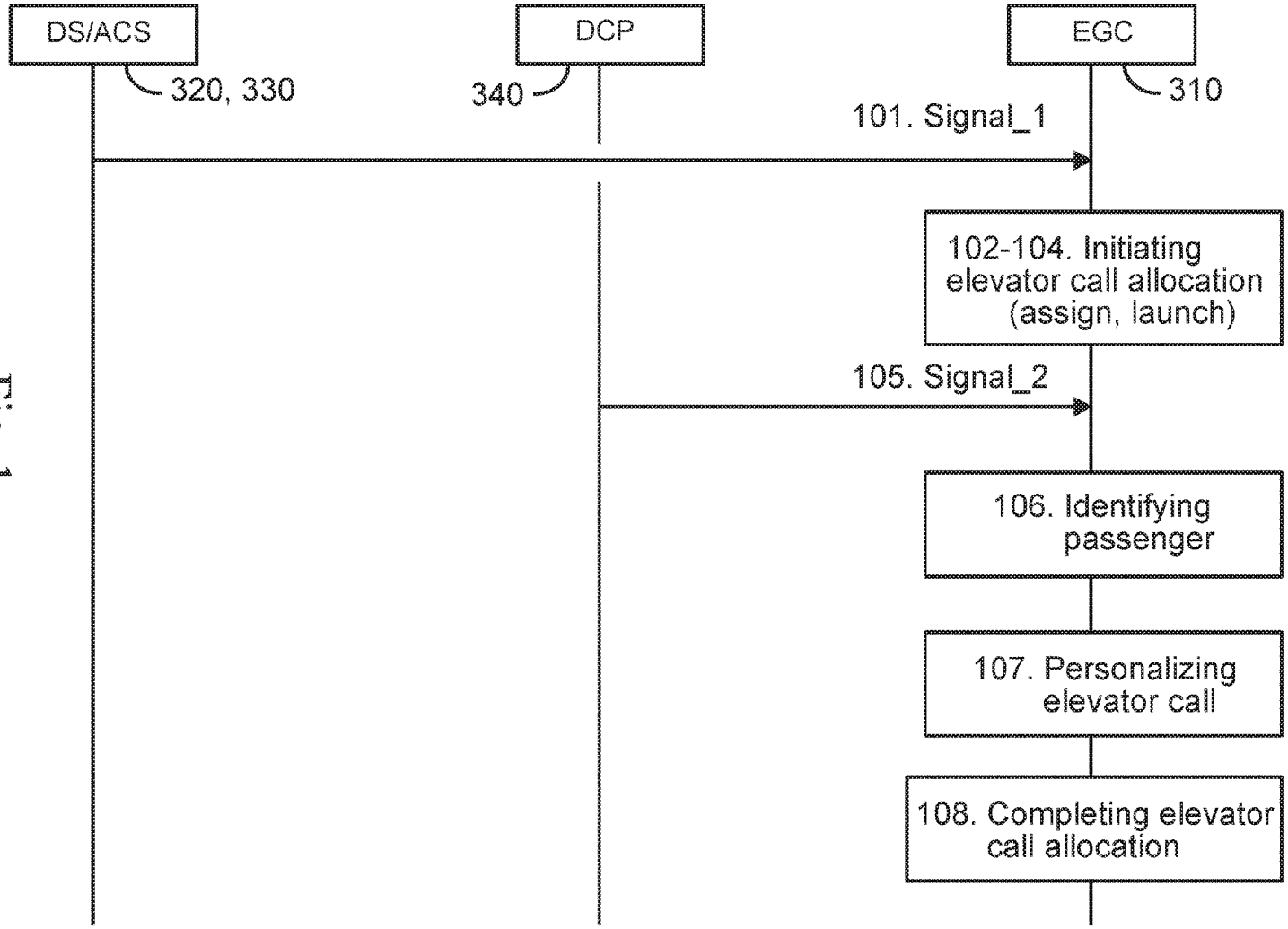
FIG. 1 is a signaling diagram illustrating a method according to an embodiment of the present invention.

FIG. 1 is a signaling diagram illustrating a method of pre-allocating an elevator call according to an embodiment of the present invention.

At step 101, a first signal is received at an elevator group controller of an elevator system with destination control. The first signal indicates that a passenger is detected to be approaching the elevator system at one of multiple floors associated with the elevator system.

In an embodiment of the invention, the first signal may be received at step 101 in response to a predetermined event that includes at least one of:

the passenger logs in to an access control system;

a distance sensor of the elevator system at the one of the multiple floors detects the passenger within a predetermined distance from a destination control panel of the elevator system at the one of the multiple floors;

the passenger operates the destination control panel of the elevator system; and a sensor of the elevator system at the one of the multiple floors detects the passenger being in the process of giving an elevator call.

Accordingly, even though FIG. 1 shows the first signal being received from the distance sensor 330 or the access control system 320, in another embodiment the first signal may be received from the destination control panel 340, from example (not shown in FIG. 1).

At step 102, allocation of an elevator call for the detected passenger is initiated in response to the received first signal, wherein the one of the multiple floors is assigned as, the departure floor for the elevator call. In an embodiment of the invention, the initiation of the allocation of the elevator call may comprise assigning an elevator car for the elevator call, step 103. The initiation of the allocation of the elevator call may further comprise launching the assigned elevator car towards the assigned departure floor, step 104.

At step 105, a second signal is received at the elevator group controller. The second signal indicates the destination floor selected by the passenger.

In an embodiment of the invention in which the predetermined event includes the passenger logging in to the access control system, the passenger may optionally be identified based on the logging in, step 106; and the elevator call may then be personalized for the passenger based on the identification, step 107.

It is to be noted that steps 106 and 107 may alternatively be performed before step 105.

At step 108, in response to the second signal received at step 105, the allocation of the elevator call is completed for the detected passenger.

Figure 2:
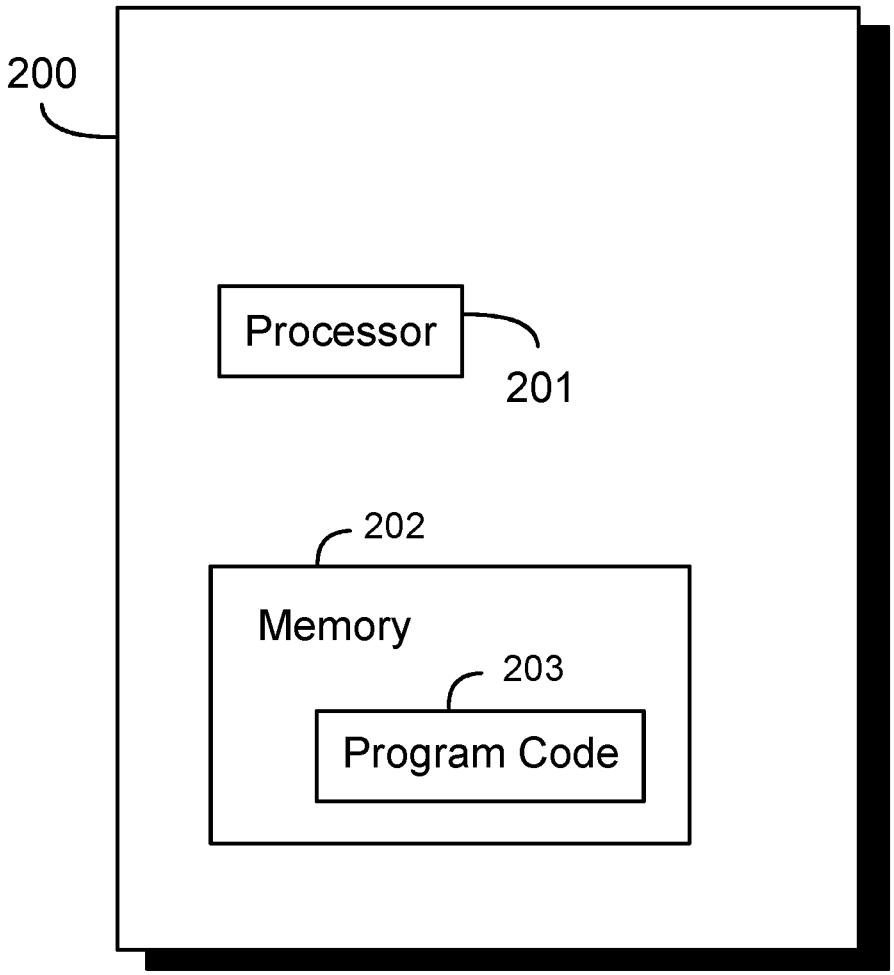
FIG. 2 is a block diagram illustrating an apparatus according to an embodiment of the present invention.
Figure 3:
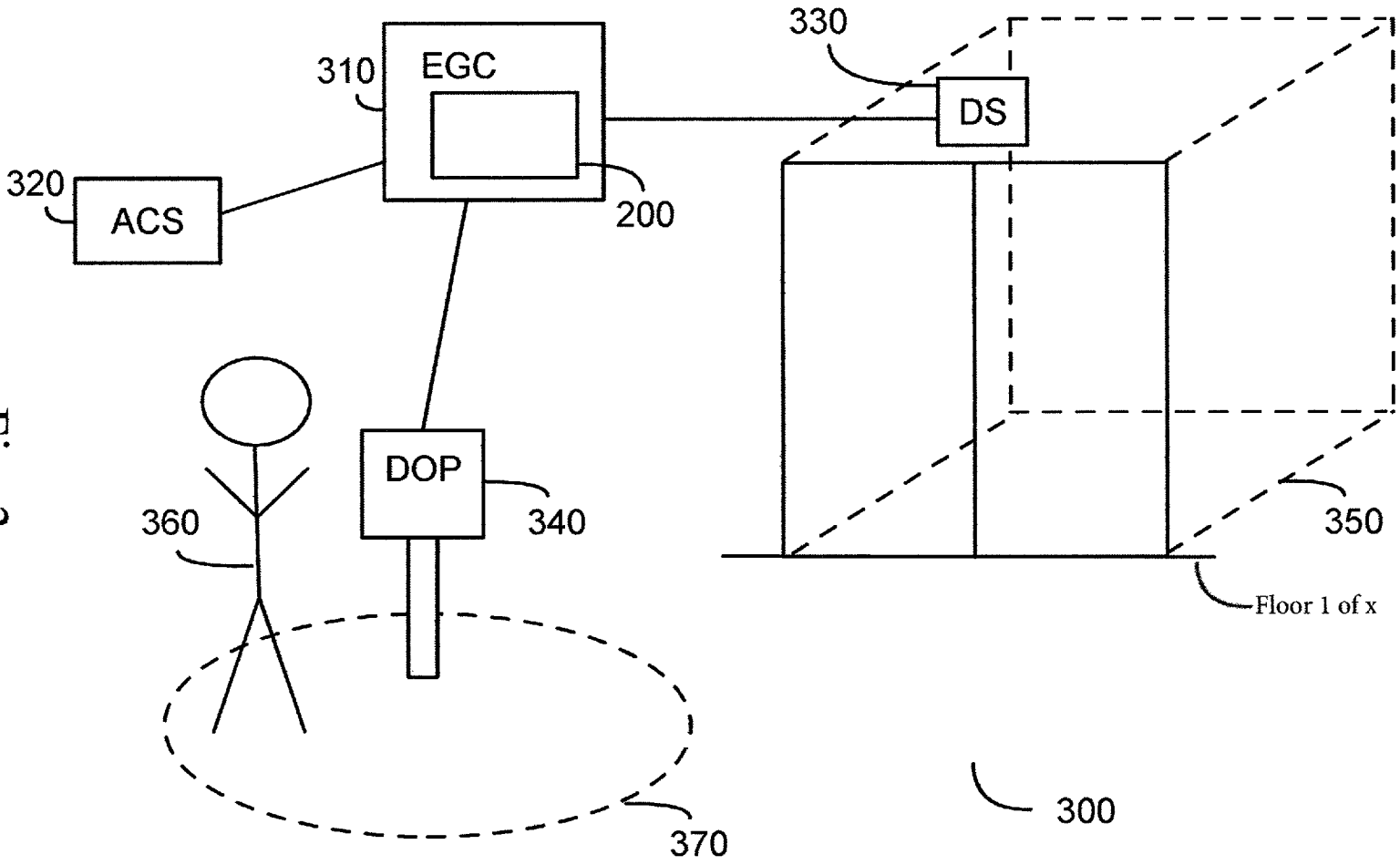
FIG. 3 illustrates an elevator system with destination control and incorporating an apparatus according to an embodiment of the present invention.

FIG. 2 is a block diagram illustrating an apparatus 200 for pre-allocating an elevator call according to an embodiment of the present invention. The apparatus 200 comprises at least one processor 201, and at least one memory 202 that includes computer program code 203. FIG. 3 in turn illustrates an elevator system 300 with destination control and incorporating the apparatus 200 of FIG. 2. As shown in FIG. 3, the apparatus 200 of the invention may be integrated in an elevator group controller 310 of the elevator system 300. Alternatively, the apparatus 200 of the invention may be implemented as an entity that is separate from the elevator group controller 310 but still communicatively in connection with the elevator group controller 310.

The elevator system 300 with destination control comprises the elevator group controller 310 for controlling various functions related to processing elevator calls and transporting elevator cars based on information collected by the destination control. The elevator system 300 further comprises an access control system 320 for providing access control functions for the building in which the elevator system 300 is located. The access control system 320 may comprise e.g. a user identification reader, such as a user identification card reader. The elevator system 300 further comprises one or more destination control panels 340 provided outside elevator cars (typically at each floor) where a passenger registers his/her destination floor call before entering the car. In an embodiment, user identification readers may be integrated in one or more destination control panels 340 (not shown in FIG. 3). The elevator system 300 in accordance with the present invention may further comprise a distance sensor 330, typically at each floor, for detecting the distance of an approaching passenger 360 from the destination control panel 340.

The at least one memory 202 and the computer program code 203 are configured to, with the at least one processor 201, cause the apparatus 200 at least to perform: receiving, at the elevator group controller 310, a first signal indicating that the passenger 360 is detected to be approaching the elevator system at one of multiple floors associated with the elevator system; and in response, initiating allocation of an elevator call for the detected passenger 360, with the one of the multiple floors assigned as the departure floor for the elevator call. The initiation of the allocation of the elevator call may comprise assigning an elevator car 350 for the elevator call, as well as launching the assigned elevator car 350 towards the assigned departure floor. Even though FIG. 3 shows only one elevator car 350 for the sake of clarity, it is to be understood that in the context of the present invention, an "elevator system" may comprise one or more elevator cars.

The first signal may be received in response to a predetermined event that includes at least one of: the passenger 360 logging in to the access control system 320; the distance sensor 330 detecting the passenger 360, e.g. stopped, within a predetermined distance 370 from the destination control panel 340 and presumably about to enter his/her destination floor call; the passenger 360 first operating the destination control panel 340 (e.g., pressing a button or touching a touch screen); and another sensor (not illustrated in FIG. 3) of the elevator system 300 detecting the passenger 360 being in the process of giving a destination floor call.

When the predetermined event includes the passenger 360 logging in to the access control system 320, the at least one memory 202 and the computer program code 203 may be further configured to, with the at least one processor 201, cause the apparatus 200 at least to perform: identifying the passenger 360 based on the logging in; and personalizing (e.g. audible passenger guidance, more space due to e.g. a wheelchair, probable destination floor, etc.) the elevator call for the passenger 360 based on the identification.

The at least one memory 202 and the computer program code 203 may be further configured to, with the at least one processor 201, cause the apparatus 200 at least to perform: receiving, at the elevator group controller 310, a second signal indicating the destination floor selected by the passenger 360 using the destination control panel 340.

The at least one memory 202 and the computer program code 203 may be further configured to, with the at least one processor 201, cause the apparatus 200 at least to perform: in response to the received second signal, completing the allocation of the elevator call for the detected passenger 360.

The exemplary embodiments can include, for example, any suitable servers, workstations, PCs, lap-top computers, other devices, and the like, capable of performing the processes of the exemplary embodiments. The devices and subsystems of the exemplary embodiments can communicate with each other using any suitable protocol and can be implemented using one or more programmed computer systems or devices.

One or more interface mechanisms can be used with the exemplary embodiments, including, for example, Internet access, telecommunications in any suitable form (e.g., voice, modem, and the like), wireless communications media, and the like. For example, employed communications networks or links can include one or more wireless communications networks, cellular communications networks, 3G communications networks, Public Switched Telephone Network (PSTNs), Packet Data Networks (PDNs), the Internet, intranets, a combination thereof, and the like.

It is to be understood that the exemplary embodiments are for exemplary purposes, as many variations of the specific hardware used to implement the exemplary embodiments are possible, as will be appreciated by those skilled in the hardware and/or software art(s). For example, the functionality of one or more of the components of the exemplary embodiments can be implemented via one or more hardware and/or software devices.

The exemplary embodiments can store information relating to various processes described herein. This information can be stored in one or more memories, such as a hard disk, optical disk, magneto-optical disk, RAM, and the like. One or more databases can store the information used to implement the exemplary embodiments of the present inventions. The databases can be organized using data structures (e.g., records, tables, arrays, fields, graphs, trees, lists, and the like) included in one or more memories or storage devices listed herein. The processes described with respect to the exemplary embodiments can include appropriate data structures for storing data collected and/or generated by the processes of the devices and subsystems of the exemplary embodiments in one or more databases.

All or a portion of the exemplary embodiments can be conveniently implemented using one or more general purpose processors, microprocessors, digital signal processors, micro-controllers, and the like, programmed according to the teachings of the exemplary embodiments of the present inventions, as will be appreciated by those skilled in the computer and/or software art(s). Appropriate software can be readily prepared by programmers of ordinary skill based on the teachings of the exemplary embodiments, as will be appreciated by those skilled in the software art. In addition, the exemplary embodiments can be implemented by the preparation of application-specific integrated circuits or by interconnecting an appropriate network of conventional component circuits, as will be appreciated by those skilled in the electrical art(s). Thus, the exemplary embodiments are not limited to any specific combination of hardware and/or software.

Stored on any one or on a combination of computer readable media, the exemplary embodiments of the present inventions can include software for controlling the components of the exemplary embodiments, for driving the components of the exemplary embodiments, for enabling the components of the exemplary embodiments to interact with a human user, and the like. Such software can include, but is not limited to, device drivers, firmware, operating systems, development tools, applications software, and the like. Such computer readable media further can include the computer program product of an embodiment of the present inventions for performing all or a portion (if processing is distributed) of the processing performed in implementing the inventions. Computer code devices of the exemplary embodiments of the present inventions can include any suitable interpretable or executable code mechanism, including but not limited to scripts, interpretable programs, dynamic link libraries (DLLs), Java classes and applets, complete executable programs, Common Passenger Request Broker Architecture (CORBA) passengers, and the like. Moreover, parts of the processing of the exemplary embodiments of the present inventions can be distributed for better performance, reliability, cost, and the like.

As stated above, the components of the exemplary embodiments can include computer readable medium or memories for holding instructions programmed according to the teachings of the present inventions and for holding data structures, tables, records, and/or other data described herein. Computer readable medium can include any suitable medium that participates in providing instructions to a processor for execution. Such a medium can take many forms, including but not limited to, non-volatile media, volatile media, transmission media, and the like. Non-volatile media can include, for example, optical or magnetic disks, magneto-optical disks, and the like. Volatile media can include dynamic memories, and the like. Transmission media can include coaxial cables, copper wire, fiber optics, and the like. Transmission media also can take the form of acoustic, optical, electromagnetic waves, and the like, such as those generated during radio frequency (RF) communications, infrared (IR) data communications, and the like. Common forms of computer-readable media can include, for example, a floppy disk, a flexible disk, hard disk, magnetic tape, any other suitable magnetic medium, a CD-ROM, CD±R, CD±RW, DVD, DVD-RAM, DVD±RW, DVD±R, HD DVD, HD DVD-R, HD DVD-RW, HD DVD-RAM, Blu-ray Disc, any other suitable optical medium, punch cards, paper tape, optical mark sheets, any other suitable physical medium with patterns of holes or other optically recognizable indicia, a RAM, a PROM, an EPROM, a FLASH-EPROM, any other suitable memory chip or cartridge, a carrier wave or any other suitable medium from which a computer can read.

If desired, the different functions discussed herein may be performed in a different order and/or concurrently with each other.

While the present inventions have been described in connection with a number of exemplary embodiments, and implementations, the present inventions are not so limited, but rather cover various modifications, and equivalent arrangements, which fall within the purview of prospective claims.

The invention claimed is:

1. A method of pre-allocating an elevator call, comprising:

receiving, at an elevator group controller of an elevator system with destination control, a first signal indicating that a passenger is detected to be approaching the elevator system at one of multiple floors associated with the elevator system, the first signal being sent in response to a distance sensor of the elevator system at said one of said multiple floors detecting said passenger within a predetermined distance from a destination control panel of the elevator system at said one of said multiple floors; and in response, initiating allocation of an elevator call for the detected passenger, with said one of said multiple floors assigned as the departure floor for said elevator call prior to receiving a second signal indicating a destination floor selected by the detected passenger; and receiving, at the elevator group controller, a second signal indicating a destination floor selected by the detected passenger.

2. The method according to claim 1, further comprising:

in response to said received second signal, completing said allocation of the elevator call for said detected passenger.

3. The method according to claim 1 or 2, wherein said initiation of the allocation of the elevator call comprises assigning an elevator car for the elevator call.

4. The method according to claim 3, wherein said initiation of the allocation of the elevator call further comprises launching the assigned elevator car towards the assigned departure floor.

5. A method of pre-allocating an elevator call, comprising:

receiving, at an elevator group controller of an elevator system with destination control, a first signal indicating that a passenger is detected to be approaching the elevator system at one of multiple floors associated with the elevator system; and in response, initiating allocation of an elevator call for the detected passenger, with said one of said multiple floors assigned as the departure floor for said elevator call prior to receiving a second signal indicating a destination floor selected by the detected passenger; and receiving, at the elevator group controller, a second signal indicating a destination floor selected by the detected passenger, wherein said first signal is received in response to said passenger logging in to an access control system, and the method further comprises identifying said passenger based on said logging in; and personalizing the elevator call for said passenger based on said identification.

6. An apparatus for pre-allocating an elevator call, comprising:

at least one processor; and at least one memory including computer program code;

the at least one memory and the computer program code configured to, with the at least one processor, cause the apparatus at least to perform:

receiving, at an elevator group controller of an elevator system with destination control, a first signal indicating that a passenger is detected to be approaching the elevator system at one of multiple floors associated with the elevator system, the first signal being sent in response to a distance sensor of the elevator system at said one of said multiple floors detecting said passenger within a predetermined distance from a destination control panel of the elevator system at said one of said multiple floors;

in response, initiating allocation of an elevator call for the detected passenger, with said one of said multiple floors assigned as the departure floor for said elevator call prior to receiving a second signal indicating a destination floor selected by the detected passenger; and receiving, at the elevator group controller, a second signal indicating a destination floor selected by the detected passenger.

7. The apparatus according to claim 6, wherein the at least one memory and the computer program code are further configured to, with the at least one processor, cause the apparatus at least to perform:

in response to said received second signal, completing said allocation of the elevator call for said detected passenger.

8. The apparatus according to claim 6 or 7, wherein said initiation of the allocation of the elevator call comprises assigning an elevator car for the elevator call.

9. The apparatus according to claim 8, wherein said initiation of the allocation of the elevator call further comprises launching the assigned elevator car towards the assigned departure floor.

10. An apparatus for pre-allocating an elevator call, comprising:

at least one processor; and at least one memory including computer program code;

the at least one memory and the computer program code configured to, with the at least one processor, cause the apparatus at least to perform:

receiving, at an elevator group controller of an elevator system with destination control, a first signal indicating that a passenger is detected to be approaching the elevator system at one of multiple floors associated with the elevator system, said first signal being received in response to said passenger logging in to an access control system;

in response, initiating allocation of an elevator call for the detected passenger, with said one of said multiple floors assigned as the departure floor for said elevator call prior to receiving a second signal indicating a destination floor selected by the detected passenger;

receiving, at the elevator group controller, a second signal indicating a destination floor selected by the detected passenger;

identifying said passenger based on said logging in; and personalizing the elevator call for said passenger based on said identification.

11. A non-transitory computer readable medium having stored thereon program code adapted to cause the following when executed on a data-processing system:

receiving, at an elevator group controller of an elevator system with destination control, a first signal indicating that a passenger is detected to be approaching the elevator system at one of multiple floors associated with the elevator system, the first signal being sent in response to a distance sensor of the elevator system at said one of said multiple floors detecting said passenger within a predetermined distance from a destination control panel of the elevator system at said one of said multiple floors;

in response, initiating allocation of an elevator call for the detected passenger, with said one of said multiple floors assigned as the departure floor for said elevator call prior to receiving a second signal indicating a destination floor selected by the detected passenger; and receiving, at the elevator group controller, a second signal indicating a destination floor selected by the detected passenger.

12. An elevator system with destination control, comprising the apparatus according to claim 6.

* * * * *